US007253569B2

(12) United States Patent
Liu

(10) Patent No.: US 7,253,569 B2
(45) Date of Patent: Aug. 7, 2007

(54) OPEN LAMP DETECTION IN AN EEFL BACKLIGHT SYSTEM

(75) Inventor: Da Liu, Milpitas, CA (US)

(73) Assignee: 02Micro International Limited, Georgetown Grand Cayman (KY)

( * ) Notice: Subject to any disclaimer, the term of this patent is extended or adjusted under 35 U.S.C. 154(b) by 0 days.

(21) Appl. No.: 11/216,650

(22) Filed: Aug. 31, 2005

(65) Prior Publication Data

US 2007/0046217 A1 Mar. 1, 2007

(51) Int. Cl.
*G05F 1/00* (2006.01)

(52) U.S. Cl. ..... 315/291; 315/224; 315/209 R; 315/277; 315/312; 315/DIG. 7; 345/102; 345/52

(58) Field of Classification Search ..... 315/291, 315/307, 224, 276, 209 R, 244, 247, 225, 315/312, DIG. 7, 255, 277; 345/30, 52, 345/46–48, 102; 363/56.08
See application file for complete search history.

(56) References Cited

U.S. PATENT DOCUMENTS 5,652,479 A * 7/1997 LoCascio et al. ..... 315/225
6,400,096 B1 * 6/2002 Wells et al. ..... 315/224
6,559,606 B1 5/2003 Chou et al.
6,919,697 B2 * 7/2005 Jang ..... 315/291
6,954,364 B2 * 10/2005 Min ..... 363/56.08
2003/0214478 A1 * 11/2003 Yoo et al. ..... 345/102
2004/0257796 A1 * 12/2004 Huang et al. ..... 362/31
2005/0269973 A1 * 12/2005 Jang et al. ..... 315/307
2005/0285548 A1 * 12/2005 Moyer et al. ..... 315/312
2006/0076900 A1 * 4/2006 Chen et al. ..... 315/209 R

* cited by examiner

*Primary Examiner*—Haissa Philogene
(74) *Attorney, Agent, or Firm*—Grossman, Tucker, Perreault & Pfleger, PLLC

(57) ABSTRACT

A method according to one embodiment may include supplying power to plurality of External Electrode Fluorescent Lamps (EEFLs). The method of this embodiment may also include generating signals proportional to the voltage of each EEFL. The method of this embodiment may also include generating a feedback signal indicative of the state of one or more of the plurality of EEFLs based on, at least in part, the value of at least one signal proportional to the voltage of each EEFL. Of course, many alternatives, variations, and modifications are possible without departing from this embodiment.

14 Claims, 7 Drawing Sheets

OPEN LAMP DETECTION IN AN EEFL BACKLIGHT SYSTEM

FIELD

The present disclosure relates to open lamp detection in an EEFL backlight system.

BACKGROUND

External Electrode Fluorescent Lamps (EEFL) are widely used in LCD panel backlight applications. Since the operational impedance of an EEFL has positive V-I characteristic, many individual EEFL lamp tubes may be connected in parallel, all of which may be driven by a single pair of inverter circuit. However, connecting multiple EEFLs directly in parallel presents difficulties for open/broken lamp detection in EEFL backlight system design since only the total current supplied to all the lamps in the panel, in aggregate, is sensed, rather than sensing the current of individual lamps in the system.

For example, in one conventional EEFL backlight system, open lamp detection is implemented by detecting the operational voltage of EEFL lamps. The total amount of current flow through all the lamps is controlled by a DC/AC inverter. If any lamp is broken, the total current will not change, and the rest of lamps will share the amount of current previously provided to the broken lamp. This results in lamp voltage increase in the remaining lamps due to increase of current in each of the remaining lamps. If the voltage is higher than a threshold, a DC/AC inverter judges an open lamp condition. Since the normal operation voltage of an EEFL lamp has at least +/−10% tolerance and also varies with temperature, this method is only able to detect if more than ¼ of total number of EEFLs become broken. For example, in a 20 EEFL backlight system, this conventional EEFL backlight system is unable to detect if less than 5 lamps are broken, since the lamp voltage change of less than 5 broken lamps is within the normal operation voltage tolerance range.

SUMMARY

In one embodiment, the present disclosure may provide a system that includes a liquid crystal display (LCD) panel comprising a plurality of External Electrode Fluorescent Lamps (EEFLs). The system may also include power supply circuitry capable of supplying power to the plurality of EEFLs. The system may additionally include a plurality of lamp voltage monitoring circuits, each electrically coupled to a respective EEFL, and each lamp voltage monitoring circuit is capable generating a signal proportional to the voltage of the EEFL. The system may further include open lamp detection circuitry capable of receiving each signal proportional to the voltage of each EEFL and generating a feedback signal indicative of the state of one or more of the plurality of EEFLs based on, at least in part, the value of at least one signal proportional to the voltage of the EEFL.

In another embodiment, a circuit may be provided that includes power supply circuitry capable of supplying power to plurality of External Electrode Fluorescent Lamps (EEFLs). The circuit may also include a plurality of lamp voltage monitoring circuits, each electrically coupled to a respective EEFL, and each lamp voltage monitoring circuit is capable generating a signal proportional to the voltage of the EEFL. The circuit may also include open lamp detection circuitry capable of receiving each signal proportional to the voltage of each EEFL and generating a feedback signal indicative of the state of one or more of said plurality of EEFLs based on, at least in part, the value of at least one said signal proportional to the voltage of the EEFL.

Another embodiment may provide a method that includes supplying power to plurality of External Electrode Fluorescent Lamps (EEFLs). The method may also include generating signals proportional to the voltage of each EEFL. The method may further include generating a feedback signal indicative of the state of one or more of said plurality of EEFLs based on, at least in part, the value of at least one signal proportional to the voltage of each EEFL.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

Although the following Detailed Description will proceed with reference being made to illustrative embodiments, many alternatives, modifications, and variations thereof will be apparent to those skilled in the art. Accordingly, it is intended that the claimed subject matter be viewed broadly, and be defined only as set forth in the accompanying claims.

DETAILED DESCRIPTION

Figure 1:
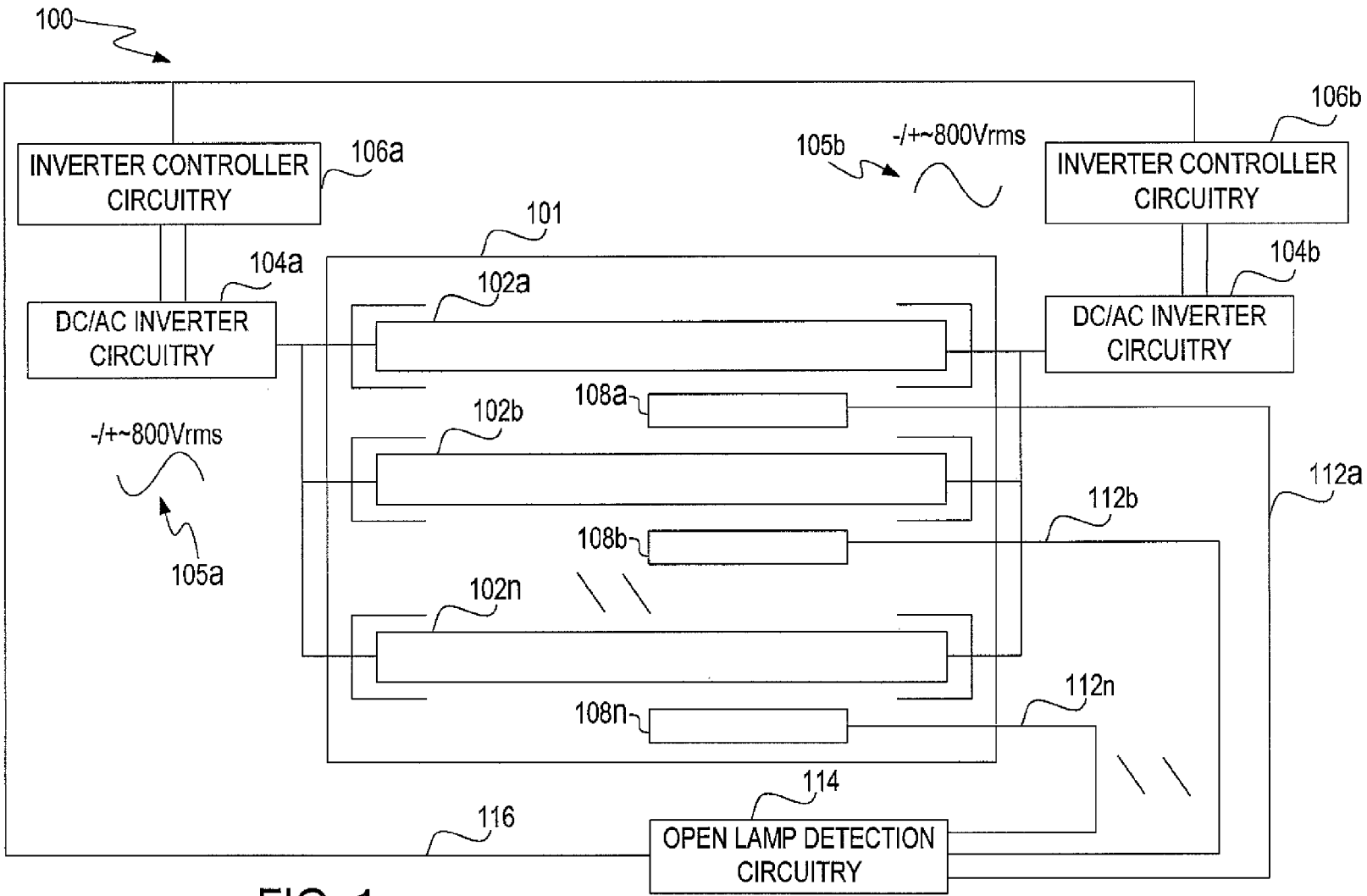
FIG. 1 is a diagram illustrating one exemplary system embodiment.

FIG. 1 illustrates a system embodiment 100 of the claimed subject matter. The system 100 may generally include a liquid crystal display (LCD) panel 101 that includes a plurality of External Electrode Fluorescent Lamp (EEFL) tubes 102*a*, 102*b*, . . . , 102*n* widely used in LCD panel backlight applications. The lamps may be coupled in parallel between a pair of power supplies. EEFL lamps, as is well-known in the art, may include neon, argon and/or mercury gas that is electrically charged to produce light.

The power supply circuitry to supply power to the EEFL tubes of panel 110 may include a complimentary pair of DC/AC inverter circuits delivering power to either end of each EEFL tube. The complimentary pair of inverter circuits may include, for example, DC/AC inverter circuitry 104*a* and inverter controller circuitry 106*a* capable of generating an AC signal from a DC signal and of supplying a sinusoidal AC power signal 105*a* on one end of the tubes, and DC/AC inverter circuitry 104*b* and inverter controller circuitry 106*b* capable of generating an AC signal from a DC signal and of supplying a sinusoidal AC power signal 105*b* on the other end of the tubes. In at least one embodiment described herein, AC power signals 105*a* and 105*b* may be approximately 800 Volts to supply a steady state voltage to the EEFL tubes.

DC/AC inverter circuitry 104*a* and/or 104*b* may include a plurality of switches arranged in a full bridge, half bridge, active clamp, forward, push-pull and/or Class D type inverter topologies, however, existing and/or after-developed inverter topologies are equally contemplated herein and shall be deemed as equivalent structures. DC/AC inverter circuitry 104*a* and/or 104*b* may also include power train circuitry that may include, for example, a transformer and resonant tank circuit capable of delivering high-voltage AC power to one or more lamps.

The power supply circuitry may be coupled together using a synchronization signal (not shown) so that the controllers 106*a* and 106*b* control their respective inverter circuits 104*a* and 104*b* to generate sinusoidal power signal 105*a* and 105*b* that are approximately 180 degrees out of phase, as shown. This may ensure, for example that each lamp receives full power from each inverter during each half cycle without cancellation of the power signals. It should be understood out the outset that the terms "circuit" and circuitry" used herein may be used interchangeably throughout this disclosure.

The system 100 may also lamp voltage monitoring circuitry 108*a*, 108*b*, . . . , 108*n*. In this embodiment, separate lamp voltage monitoring circuitry may be electrically coupled to each respective lamp tube 102*a*, 102*b*, . . . , 102*n*, although it is equally contemplated herein a system that includes less lamp voltage monitoring circuitry than lamps. Additionally, in this embodiment the respective construction and operation of each of the lamp voltage monitoring circuits 108*a*, 108*b*, . . . , 108*n* may be respectively identical. Each lamp voltage monitoring circuit 108*a*, 108*b*, . . . , 108*n* may be electrically coupled to a respective lamp and capable of generating a respective signal 112*a*, 112*b*, . . . , 112*n* indicative of, or proportional to, the lamp voltage. Also, and as will be described in greater detail below, since the lamp voltage may vary along the length of the lamp tube, each lamp monitoring circuit 108*a*, 108*b*, . . . , 108*n* may be electrically coupled to a respective lamp at a predetermined point along the lamp to generate a desired lamp voltage signal 112*a*, 112*b*, . . . , 112*n*.

This embodiment may also include open lamp detection circuitry 114. Open lamp detection circuitry 114 may be capable of receiving one or more signals 112*a*, 112*b*, . . . , 112*n* generated by the lamp voltage monitoring circuits 108*a*, 108*b*, . . . , 108*n*. Based at least in part on the value of one or more signals 112*a*, 112*b*, . . . , 112*n*, open lamp detection circuitry 114 may also be capable of generating a signal 116 indicative of the state of one or more lamps comprised in panel 101. The "state" of a lamp may be defined as an open lamp (e.g., broken or missing lamp) or a normal lamp. Inverter controller circuitry 106*a* and/or 106*b* may be capable of receiving signal 116 and adjusting power supplied to the lamps based on, at least in part, a value of signal 116. Thus, for example, if signal 116 is indicative of one or more broken lamps in panel 101, inverter controller circuitry 106*a* and/or 106*b* may control respective DC/AC inverter circuitry 104*a* and/or 104*b* to reduce the total current supplied to the lamps.

Figure 2A:
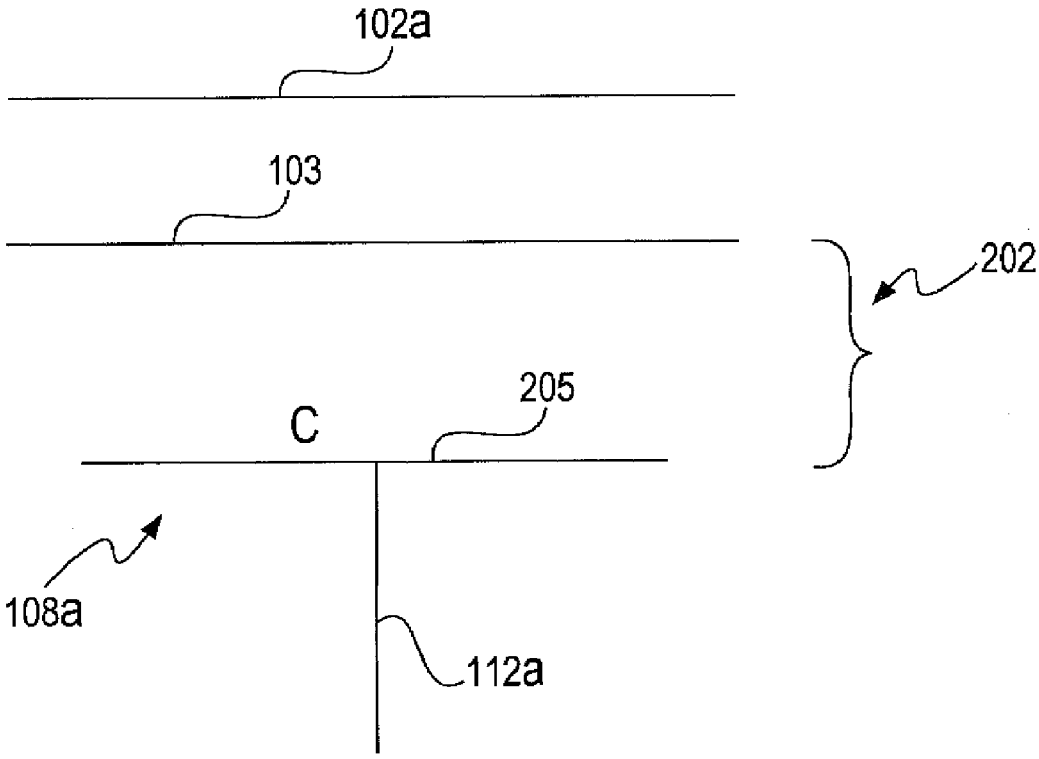
FIG. 2A is a diagram illustrating exemplary lamp voltage monitor monitoring circuitry according to one embodiment.

FIG. 2A is a diagram illustrating exemplary lamp voltage monitor monitoring circuitry according to one embodiment. In particular, FIG. 2A illustrates in greater detail lamp voltage monitoring circuitry coupled to EEFL tube 102*a*. In FIG. 2A, certain portions of the system 100 depicted in FIG. 1 have been omitted for clarity (for example, power supply circuitry and open lamp detection circuitry), but it is to be understood that like parts of FIG. 2A can be implemented in a manner consistent with an embodiment depicted in FIG. 1, or alternatively in other system implementations, without departing from this embodiment. This embodiment depicts EEFL tube 102*a* and lamp voltage monitoring circuitry 108*a* (generating signal 112*a*), however, it should be understood that the following description could apply equally to any of the EEFL tubes comprised in the panel 101.

EEFL tube 102*a* may be formed of glass and may include a sidewall portion 103. Lamp voltage monitoring circuit 108*a* may comprise a conductive element 205 disposed in proximity to the sidewall portion 103, thus forming a capacitor C between the potential inside the tube 102*a* and the conductive element 205. Conductive element 205 may be disposed approximately parallel to the sidewall portion 103 and spaced apart there from by a defined gap 202. Of course, the gap 202 may comprise a free-space gap in which the dielectric is air and/or other well-known dielectric material may be disposed in gap 202. The capacitor formed by the conductive element 205 and the tube 102*a* may generate signal 112*a* proportional to the voltage of the tube. The value (e.g., amplitude) of signal 112*a* may be based on, for example, the capacitance value (C) and the location of the conductive element 205 with respect to the length of the tube.

Figure 2B:
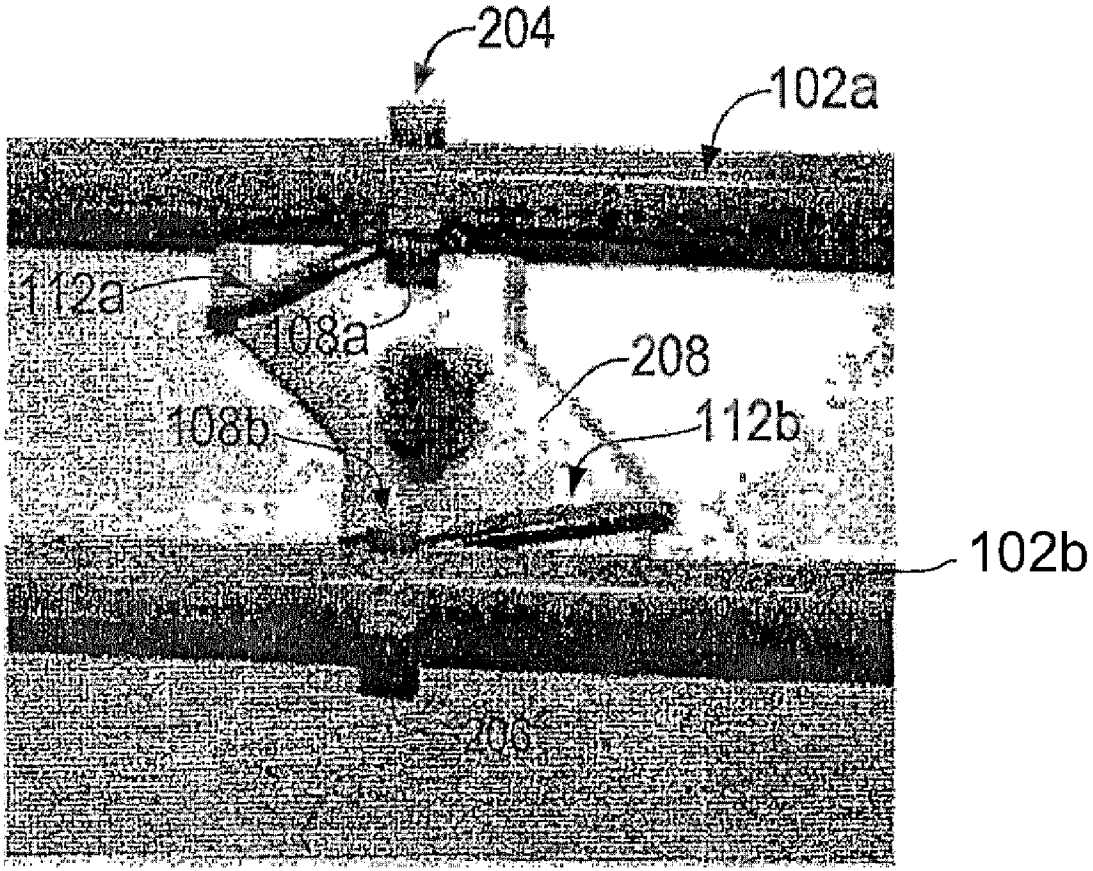
FIG. 2B is a diagram illustrating exemplary lamp voltage monitor monitoring circuitry according to another embodiment.

FIG. 2B is a diagram illustrating exemplary lamp voltage monitor monitoring circuitry according to another embodiment. In particular, FIG. 2B illustrates in greater detail lamp voltage monitoring circuitry disposed within a mounting bracket used to secure one or more EEFL tubes. In FIG. 2B, certain portions of the system 100 depicted in FIG. 1 have been omitted for clarity (for example, power supply circuitry and open lamp detection circuitry), but it is to be understood that like parts of FIG. 2B can be implemented in a manner consistent with an embodiment depicted in FIG. 1, or alternatively in other system implementations, without departing from this embodiment. This embodiment depicts EEFL tubes 102*a* and 102*b* and lamp voltage monitoring circuitry 108*a* and 108*b* (generating respective signals 112*a* and 112*b*), however, it should be understood that the following description could apply equally to any of the EEFL tubes comprised in the panel 101.

In this embodiment, the panel 101 may include a bracket 208 capable of securing two lamps, for example lamps 102*a* and 102*b*. The bracket 208 may include respective clamps 204 and 206 capable of securing a respective lamp to the bracket 208. The bracket 208, in turn, may be secured to the enclosure (not shown) of panel 101, to prevent movement of the EEFL tubes. The bracket 208 and clamps 204 and 206 may be formed of an insulating material such as ceramic or plastic. Conductive elements 108*a* and 108*b* may be disposed within respective clamps 204 and 206, spaced apart from respective EEFL tubes 102*a* and 102*b* (e.g., in a manner consistent with the previous embodiment of FIG. 2A). Wires may be attached to respective conductive elements 108*a* and 108*b* which may be capable of transmitting signals 112*a* and 112*b*, respectively.

Figure 3:
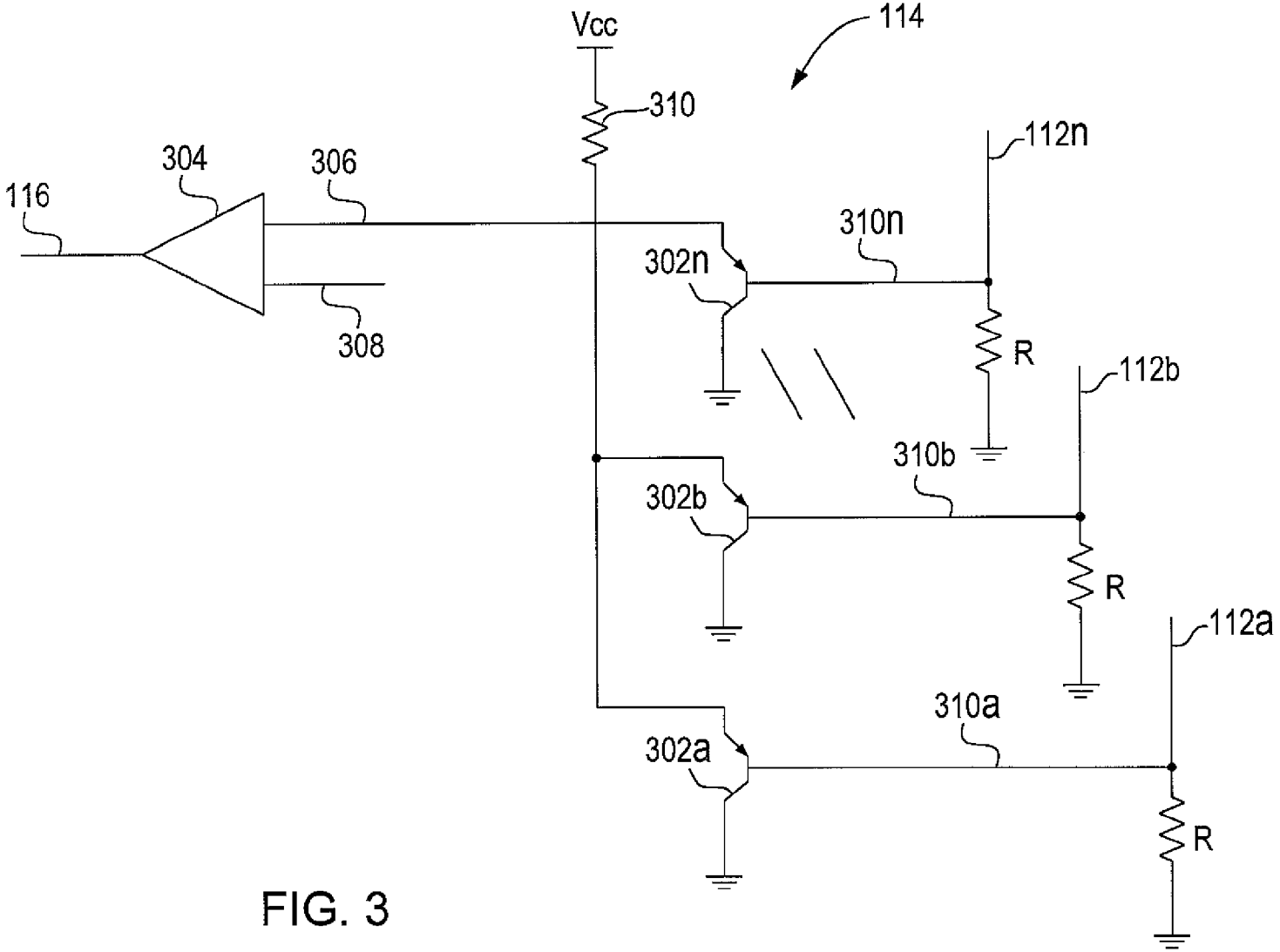
FIG. 3 is a diagram illustrating exemplary open lamp detection circuitry according to one embodiment.

FIG. 3 is a diagram illustrating exemplary open lamp detection circuitry 114 according to one embodiment. In FIG. 3, certain portions of the system 100 depicted in FIG. 1 have been omitted for clarity (for example, power supply circuitry and lamp voltage monitoring circuitry), but it is to be understood that like parts of FIG. 3 can be implemented in a manner consistent with an embodiment depicted in FIG. 1, or alternatively in other system implementations, without departing from this embodiment.

In this embodiment, open lamp detection circuitry 114 may include a comparator 304 capable of comparing the voltage generated by the lamp voltage monitoring circuitry (i.e., signals 112*a*, 112*b*, . . . , 112*n*) to an open lamp detection threshold signal 308, and generating a feedback signal 316 indicative of the state of one or more lamps in an EEFL panel.

Circuitry 114 may also include a plurality of switches 302*a*, 302*b*, . . . , 302*n*. The conduction state (i.e., ON and OFF) of each switch may be controlled by a signal proportional to a respective signal 112*a*, 112*b*, . . . , 112*n*. In this example, a respective resistor R may be coupled between signals 112*a*, 112*b*, . . . , 112*n* and ground, thus forming an RC voltage divider. Since the voltage in the EEFL tube may be sinusoidal, the voltage across the RC network may generate respective sinusoidal signals 310*a*, 310*b*, . . . , 310*n* proportional to the value of signals 112*a*, 112*b*, . . . , 112*n*, respectively.

Signals 310*a*, 310*b*, . . . , 310*n* may be used to control the conduction state of respective switches 302*a*, 302*b*, . . . , 302*n*. Switches 302*a*, 302*b*, . . . , 302*n* may comprise, for example BJT transistors or MOSFET transistors, and in this example PNP transistors may be used having an active low operation. The emitter of each switch may be coupled to a reference voltage Vcc, through resistor 310, and to the positive input terminal 306 of comparator 304.

During normal lamp operation, signals 310*a*, 310*b*, . . . , 310*n* may have sufficient amplitude to cause each respective switch to swing between an OFF state (when the respective sinusoid is high enough to turn the switch OFF) and an ON state every half cycle. This may cause, for example, the voltage at terminal 306 to swing between Vcc and approximately zero Volts (Vbe). When one or more lamps in panel 101 are broken or missing, signals 310*a*, 310*b*, . . . , 310*n* may have an amplitude to cause each respective switch to remain in an ON (conductive state). In other words, the amplitude of one or more signals 310*a*, 310*b*, . . . , 310*n* may not be sufficient to cause a respective switch to turn OFF. This may cause, for example, the voltage at terminal 306 to remain at approximately zero volts (Vbe).

Reference voltage 308 may be selected to be between Vcc and zero volts (Vbe). Thus, during normal lamp operation, the output 316 of comparator 304 may swing between a High value, when voltage 306 is greater than reference voltage 308, to a Low value, when voltage 306 is less than reference 308 (and vice-versa) for each half cycle of the sinusoidal signals 310*a*, 310*b*, . . . , 310*n* used to control respective switches 302*a*, 302*b*, . . . , 302*n*. When a lamp is missing or broken, the output 316 of comparator 304 may remain low, since the input voltage 306 may be less than the reference voltage 308.

In operation, inverter controller circuitry 106*a* and 106*b* may use feedback signal 316 to adjust power delivered to the lamp. Thus, for example, if feedback signal 316 swings between a High and Low values, inverter controller circuitry 106*a* and 106*b* may interpret this feedback information as an indication that all lamps in the panel 101 are operating properly. If, however, feedback signal 316 remains low, inverter controller circuitry 106*a* and 106*b* may interpret this feedback information as an indication that one or more lamps in panel 101 are broken or missing, and inverter controller circuitry 106*a* and 106*b* may control respective DC/AC inverter circuitry 104*a* and 104*b* to adjust (e.g., reduce) power delivered to the lamps according the number of remaining normal lamps, or turn off power to all the lamps.

Alternatively or additionally, and not shown in this figure, this embodiment may include an averaging circuit, coupled to the output of comparator 304, and capable of generating a signal of the average of the output of the comparator. An averaging circuit may thus generate a nonzero signal if the lamps are operating properly and a zero value if one or more lamps are broken or missing.

Figure 4:
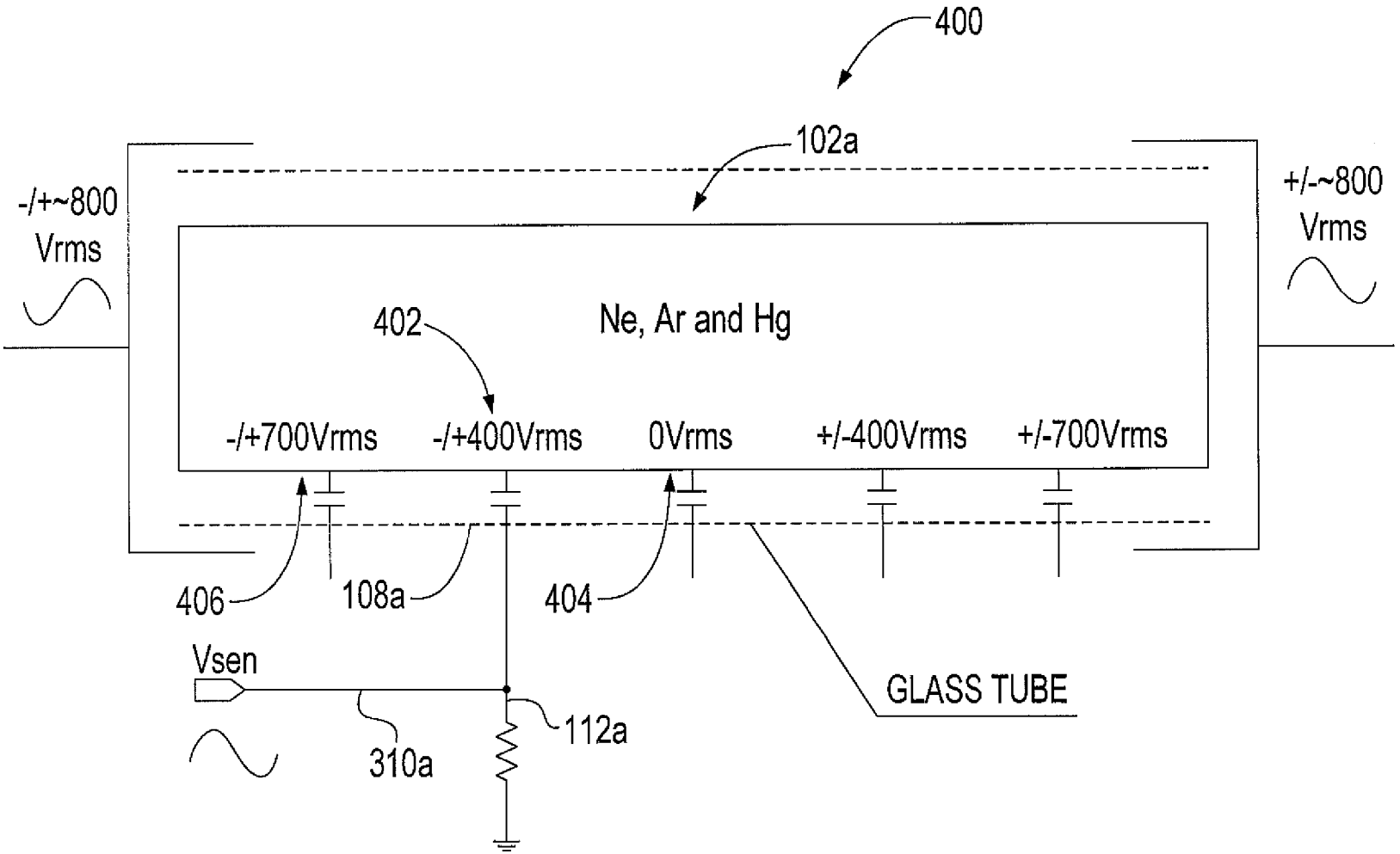
FIG. 4 is a diagram illustrating in detail an exemplary EEFL tube according to one embodiment.

FIG. 4 is a diagram illustrating in detail an exemplary EEFL tube 400 according to one embodiment. Specifically, FIG. 4 depicts EEFL tube 102*a* during normal operating conditions. In FIG. 4, certain portions of the system 100 depicted in FIG. 1 have been omitted for clarity (for example, power supply circuitry and open lamp detection circuitry), but it is to be understood that like parts of FIG. 4 can be implemented in a manner consistent with an embodiment depicted in FIG. 1, or alternatively in other system implementations, without departing from this embodiment. This embodiment depicts EEFL tube 102*a* and lamp voltage monitoring circuitry 108*a* (generating signal 112*a*), however, it should be understood that the following description could apply equally to any of the EEFL tubes comprised in the panel 101.

As stated, this embodiment depicts EEFL 102*a* during normal operating conditions. For example, each side of the tube 102*a* may be supplied with complimentary 800 Volts AC power. Left to right in the Figure along the length of the tube, the voltage may taper from 800 Volts at the ends to a point 406 that has 700 Volts, a point 402 that has 400 Volts, down to the center point 404 of the tube which may exhibit approximately zero Volts. Of course, from the zero point 404, the voltage may taper back up toward 800 Volts. As stated, the value of signal 112*a* may be based on, at least in part, the value of the capacitance C of circuit 108*a*, the value of resistance R, and the point at which circuit 108*a* is electrically coupled to the tube 102*a* (which, in this example is point 402). Here, in this example, signal 310 has an amplitude that is greater than the threshold signal 308, which in turn may generate feedback signal 316 as described above with reference to FIG. 3.

Figure 5:
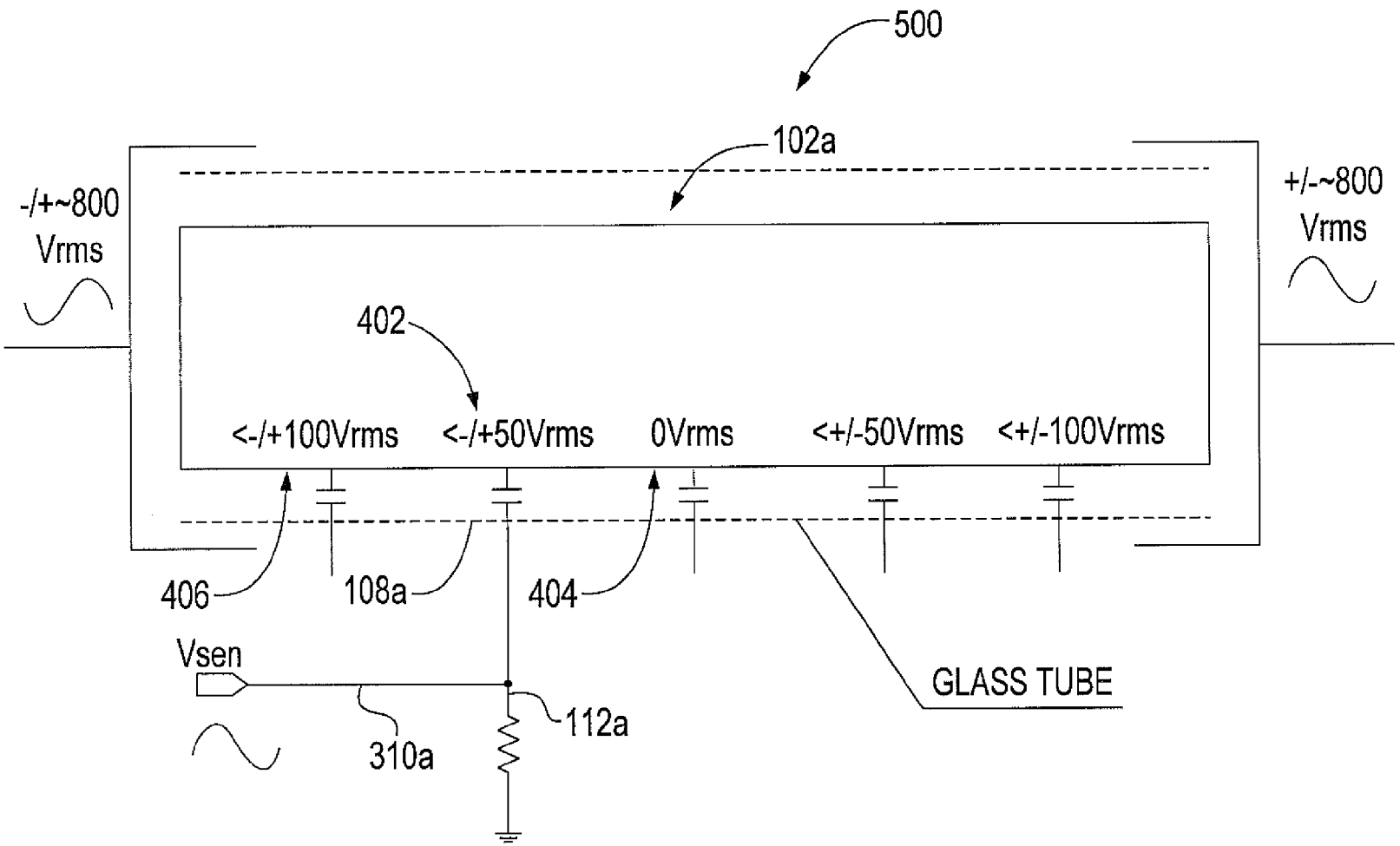
FIG. 5 is a diagram illustrating in detail another exemplary EEFL tube according to another embodiment.

FIG. 5 is a diagram illustrating in detail an exemplary EEFL tube 500 according to another embodiment. Specifically, FIG. 5 depicts a broken EEFL tube 102*a*. In FIG. 5, certain portions of the system 100 depicted in FIG. 1 have been omitted for clarity (for example, power supply circuitry and open lamp detection circuitry), but it is to be understood that like parts of FIG. 5 can be implemented in a manner consistent with an embodiment depicted in FIG. 1, or alternatively in other system implementations, without departing from this embodiment. This embodiment depicts EEFL tube 102*a* and lamp voltage monitoring circuitry 108*a* (generating signal 112*a*), however, it should be understood that the following description could apply equally to any of the EEFL tubes comprised in the panel 101.

As stated, this embodiment depicts a broken EEFL 102*a*. As with the previous embodiment, each side of the tube 102*a* may be supplied with complimentary 800 Volts AC power. However, because the tube 102*a* is broken, the tube may not be able to carry the same potential as an EEFL tube under normal operating conditions. Thus, for example and referring left to right in the Figure along the length of the tube, the voltage may taper from 800 Volts at the end of the tube to a point 406 near the end of the tube that has 100 Volts potential, to a point 402 that has 50 Volts potential, down to the center point 404 of the tube which may exhibit approximately zero Volts. Of course, from the zero point 404, the voltage may taper back up toward 800 Volts. As stated, the value of signal 112*a* may be based on, at least in part, the value of the capacitance C of circuit 108*a*, the value of resistance R, and the point at which circuit 108*a* is electrically coupled to the tube 102*a* (which, in this example is point 402). Here, in this example, signal 310 has an amplitude that is less than the threshold signal 308, which in turn may generate feedback signal 316 as described above with reference to FIG. 3.

Figure 6:
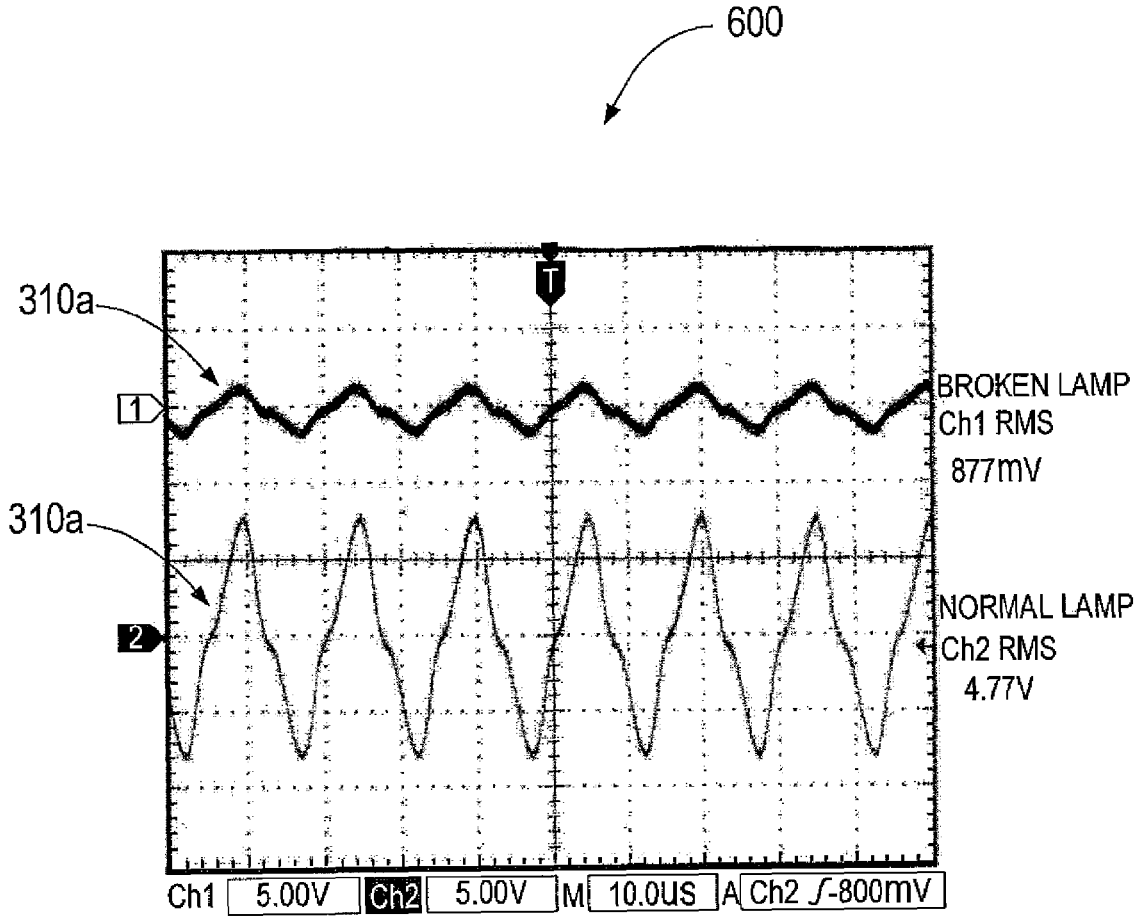
FIG. 6 is a diagram illustrating exemplary signals generated by lamp voltage monitoring circuitry of the embodiments of FIGS. 4 and 5.

FIG. 6 is a diagram 600 illustrating exemplary signals generated by lamp voltage monitoring circuitry of the embodiments of FIGS. 4 and 5. The top portion of FIG. 6 may represent the voltage waveform 310*a* when lamp is broken, as described above with reference to FIG. 5. The bottom portion of FIG. 6 may represent the voltage waveform 310*a* during normal lamp operating conditions, as described above with reference to FIG. 4. In this embodiment, the broken lamp voltage waveform is substantially less than the normal lamp voltage waveform.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. A system, comprising:

a liquid crystal display (LCD) panel comprising a plurality of External Electrode Fluorescent Lamps (EEFLs);

power supply circuitry capable of supplying power to said plurality of EEFLs;

a plurality of lamp voltage monitoring circuits, each electrically coupled to a respective EEFL, each lamp voltage monitoring circuit is capable of generating a signal proportional to the voltage of the EEFL, each lamp voltage monitoring circuit comprises a capacitor formed by a conductive element disposed adjacent to each EEFL and at a point along the length of said EEFL to generate said signal proportional to the voltage of the EEFL; and open lamp detection circuitry capable of receiving each signal proportional to the voltage of each EEFL and generating a feedback signal indicative of the state of one or more of said plurality of EEFLs based on, at least in part, the value of at least one said signal proportional to the voltage of the EEFL.

2. The system of claim 1, wherein:

said plurality of EEFLs are coupled in parallel; and said power supply circuitry comprises a complimentary pair of inverter circuits coupled to each end of the EEFLs, said inverter circuits include respective inverter controller circuitry and DC/AC inverter circuitry, each said inverter circuits generating AC power to power said EEFLs, said controller circuitry is capable of receiving said feedback signal and adjusting power delivered to said EEFLs based on, at least in part, said feedback signal.

3. The system of claim 2, wherein:

said DC/AC inverter circuitry comprises a topology selected from the group consisting of: a full bridge, half bridge, active clamp, forward, push-pull and a Class D inverter topology.

4. The system of claim 1, wherein:

said open lamp detection circuitry comprising a comparator capable of comparing the signals generated by the lamp voltage monitoring circuitry to an open lamp detection threshold signal, and generating said feedback signal indicative of the state of one or more lamps in an EEFL panel.

5. The system of claim 1, wherein:

said panel further comprises a bracket having at least one clamp for securing at least one EEFL; at least one of said lamp voltage monitoring circuits is disposed in said clamp.

6. A circuit, comprising:

power supply circuitry capable of supplying power to a plurality of External Electrode Fluorescent Lamps (EEFLs) in a panel;

a plurality of lamp voltage monitoring circuits, each electrically coupled to a respective EEFL, each lamp voltage monitoring circuit is capable of generating a signal proportional to the voltage of the EEFL, each lamp voltage monitoring circuit comprises a capacitor formed by a conductive element disposed adjacent to each said EEFL and at a point along the length of said EEFL to generate said signal proportional to the voltage of the EEFL; and open lamp detection circuitry capable of receiving each signal proportional to the voltage of each EEFL and generating a feedback signal indicative of the state of one or more of said plurality of EEFLs based on, at least in part, the value of at least one said signal proportional to the voltage of the EEFL.

7. The circuit of claim 6, wherein:

said open lamp detection circuitry comprising a comparator capable of comparing the signals generated by the lamp voltage monitoring circuitry to an open lamp detection threshold signal, and generating said feedback signal indicative of the state of one or more lamps in an EEFL panel.

8. The circuit of claim 6, wherein:

said plurality of EEFLs are coupled in parallel; and said power supply circuitry comprises a complimentary pair of inverter circuits coupled to each end of the EEFLs, said inverter circuits include respective inverter controller circuitry and DC/AC inverter circuitry, each said inverter circuits generating AC power to power said EEFLs, said controller circuitry is capable of receiving said feedback signal and adjusting power delivered to said EEFLs based on, at least in part, said feedback signal.

9. The circuit of claim 8, wherein:

said DC/AC inverter circuitry comprises a topology selected from the group consisting of: a full bridge, half bridge, active clamp, forward, push-pull and a Class D inverter topology.

10. The circuit of claim 6, wherein:

said panel further comprises a bracket having at least one clamp for securing at least one EEFL; at least one said lamp voltage monitoring circuits is disposed in said clamp.

11. A method, comprising:

supplying power to plurality of External Electrode Fluorescent Lamps (EEFLs);

disposing a conductive element adjacent to each said EEFL and at a point along the length of said EEFL:

generating, by said conductive element, signals proportional to the voltage of each EEFL; and generating a feedback signal indicative of the state of one or more of said plurality of EEFLs based on, at least in part, the value of at least one said signal proportional to the voltage of each EEFL.

12. The method of claim 11, further comprising:

disposing a conductive element within a clamp adjacent to each said EEFL and at a preselected point along the length of said EEFL to generate a desired value of said signal proportional to the voltage of the EEFL.

13. The method of claim 11, further comprising:

comparing the signals proportional to the voltage of each EEFL to an open lamp detection threshold signal, and generating said feedback signal indicative of the state of one or more lamps in an EEFL panel.

14. The method of claim 11, further comprising:

coupling said plurality of EEFLs in parallel; and adjusting power delivered to said EEFLs based on, at least in part, said feedback signal.

* * * * *